US007981502B2

(12) United States Patent
Lammer

(10) Patent No.: US 7,981,502 B2
(45) Date of Patent: Jul. 19, 2011

(54) GRIP TAPE FOR SPORTS IMPLEMENTS

(75) Inventor: Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 1600 days.

(21) Appl. No.: 10/343,702

(22) PCT Filed: Jul. 3, 2002

(86) PCT No.: PCT/EP02/07392

§ 371 (c)(1),
(2), (4) Date: May 19, 2003

(87) PCT Pub. No.: WO03/006113

PCT Pub. Date: Jan. 23, 2003

(65) Prior Publication Data

US 2003/0175495 A1 Sep. 18, 2003

(30) Foreign Application Priority Data

Jul. 13, 2001 (DE) ..... 101 34 168

(51) Int. Cl.

| | |
|---|---|
| ***B32B 3/26*** | (2006.01) |
| ***B32B 5/24*** | (2006.01) |
| ***B32B 5/22*** | (2006.01) |
| ***B32B 7/12*** | (2006.01) |
| ***B32B 15/04*** | (2006.01) |

(52) U.S. Cl. ..... 428/304.4; 428/311.11; 428/317.9; 428/343; 428/354

(58) Field of Classification Search ..... 428/304.4, 428/311.11, 317.9, 343, 354
See application file for complete search history.

(56) References Cited

U.S. PATENT DOCUMENTS

| | | | |
|---|---|---|---|
| 4,053,676 | A | 10/1977 | Kaminstein |
| 5,695,418 | A | 12/1997 | Huang |
| 5,722,482 | A | 3/1998 | Buckley |
| 5,851,338 | A | 12/1998 | Pushaw |
| 5,955,188 | A | 9/1999 | Pushaw |
| 6,077,597 | A | 6/2000 | Pause |
| 6,099,894 | A | 8/2000 | Holman |

FOREIGN PATENT DOCUMENTS

| | | |
|---|---|---|
| DE | 198 13 562 | 11/1998 |
| EP | 0 897 675 | 2/1999 |
| FR | 2 766 833 | 2/1999 |
| WO | WO 00/70983 | 11/2000 |

*Primary Examiner* — Victor S Chang
(74) *Attorney, Agent, or Firm* — Finnegan, Henderson, Farabow, Garrett & Dunner LLP

(57) ABSTRACT

The present invention relates to a grip tape (2) and replacement grip tape for sports implements, like tennis, squash, racketball and badminton rackets, or clubs, as well as to a process for producing the same. The grip tape and replacement grip tape according to the present invention comprise a phase change material for dissipating and/or storing body heat of a player, so that the grip feeling for the player is improved considerably.

42 Claims, 2 Drawing Sheets

GRIP TAPE FOR SPORTS IMPLEMENTS

TECHNICAL FIELD OF THE INVENTION

The present invention relates to a grip tape, i.e., a tape or strip to be wrapped around the handle of a sports implement, like a racket or club to be used for ball games, and to a replacement grip tape for such implements (ball game rackets or clubs), in particular tennis, squash, racketball, badminton rackets and golf clubs, as well as to processes for producing the same.

BACKGROUND OF THE INVENTION

Grip tapes of this kind for sports implements, which are also called "grips" in the art, are wrapped around the grip or handle of a sports implement so that a player can handle the sports implement in the most precise and comfortable manner. In this connection, different criteria such as, for example, tackiness or tack (adhesive force), carrying-off of moisture and cushioning effect are important. A conventional replacement grip tape is, for example, described in U.S. Pat. No. 5,695,418. This replacement grip tape comprises a felt layer, with a closed cell polyurethane layer applied to the one side thereof and an adhesive layer with a liner applied to the other side thereof. The closed cell polyurethane layer is said to improve the shock absorbing and cushioning effect.

The replacement grip tape described in U.S. Pat. No. 5,695,418 with its closed cell polyurethane layer cannot absorb moisture or can only absorb little moisture so that due to the sweat generated by the player the tackiness of the grip tape decreases as the duration of the handling of the sports implement during a match increases. Thus, the handling of the sports implement is worsened considerably. Moreover, U.S. Pat. No. 5,695,418 describes only replacement grip tapes.

Latent heat storing materials are also known in the prior art. For example DE-A-198 13 562 describes a latent heat body wherein a paraffin-based latent heat storing material is received in a support material having receiving spaces. The support material consists of individual support material elements which are, e.g., bonded together, wherein capillary receiving spaces for the latent heat storing material are formed at least between the support material elements. A further example for a latent heat storing material and the possible use thereof in low temperature protection suits, ski boot liners, thermal socks, gloves and face masks is mentioned in U.S. Pat. No. 5,722,482. Moreover, it is referred to WO-A-00/70983 which describes the use of latent heat storing materials in shoes.

SUMMARY OF THE INVENTION

It is an object of the present invention to provide an improved grip tape and replacement grip tape having in particular an improved tackiness and a better cushioning effect vis-à-vis known grip tapes. This object is achieved with the features of the claims.

In achieving this object, the invention starts out from the basic idea that for improving the tackiness, the moisture usually caused by sweat between the hand of the player and the grip tape should be avoided to a large extent. For this purpose, the grip tape according to the present invention comprises a latent heat storing material which dissipates body heat of the player and/or controls the temperature of the grip tape and/or the hand of the player during a match. In accordance with a preferred embodiment of the grip tape of the present invention, the outer layer of the grip tape, which is in contact with the hand of the player, is made of an open cell polyurethane material which is able to absorb and/or carry off moisture.

The latent heat storing materials being used in the present invention are often also called phase change materials (PCM). Examples for phase change materials of the kind useful in the present invention are described in U.S. Pat. No. 5,851,338, U.S. Pat. No. 5,955,188, U.S. Pat. No. 6,077,597 and U.S. Pat. No. 6,099,894. The phase change material used in accordance with the present invention preferably consists of fibers, fabrics or foams containing microspheres or microcapsules filled with the actual phase change material. The phase change material is selected such that the phase change from solid to liquid and vice versa, wherein heat is absorbed during liquefaction and released during solidification, takes place in a temperature range close to the body temperature of the player, e.g. at 34 to 36° C., preferably at about 35° C. Any suitable combination of phase change materials can also be used.

By means of the grip tape and replacement grip tape according to the present invention, the tackiness (adhesive force) of the grip can be improved permanently because due to the use of the phase change material the temperature of the grip tape is controlled such that the player's hand sweats less. Thus, the grip feeling and/or the tack remain more constant as compared with conventional grip tapes.

Moreover, it surprisingly turned out to be favorable that by the use of the phase change material also the cushioning effect is influenced advantageously. Thus, by the use of the grip tape and replacement grip tape according to the present invention the handling of sports implements can be improved considerably.

DETAILED DESCRIPTION OF THE PREFERRED EMBODIMENTS

Figure 1:
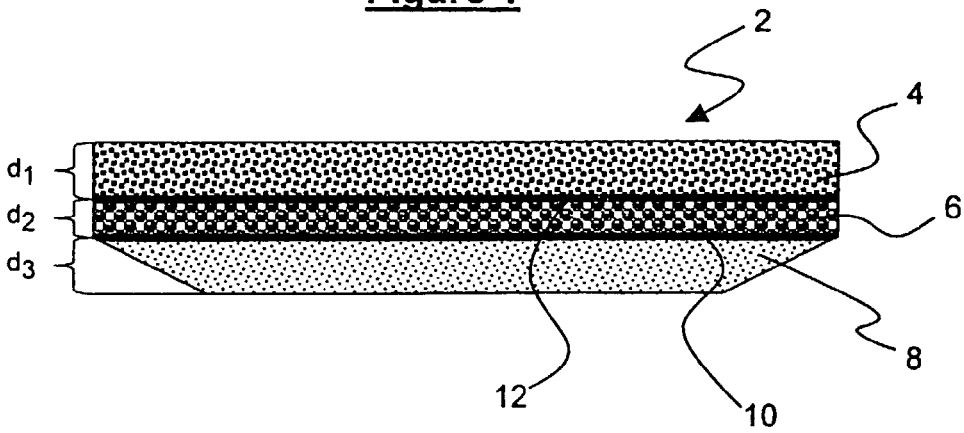
FIG. 1 is a cross-sectional view of a first embodiment of a grip tape according to the present invention.

FIG. 1 is a cross-sectional view of a grip tape 2 according to the present invention. The grip tape 2 is suitable for any kind of sports implement like ball game rackets, e.g. tennis, squash, racketball or badminton rackets, or clubs, and has an essentially longitudinal shape so that it can be wrapped around the grip or handle of a sports implement. According to the embodiment shown in FIG. 1, the grip tape 2 according to the present invention consists of three layers. This layer structure comprises an outer layer 4, a center layer 6 and an inner layer 8. When the sports implement is in use, the outer layer 4 contacts the hand of the player and should therefore be made of a suitable material which can absorb and/or carry off moisture. Particularly preferable for outer layer 4 is an open cell polyurethane material which has particularly advantageous properties as regards storing and carrying-off of moisture as well as dampening. The thickness $d_1$ of the outer layer 4 is preferably about 0.10 to 0.50 mm, particularly preferably about 0.15 to 0.25 mm.

The center layer 6 of FIG. 1 comprises at least one phase change material (PCM). Preferably, the center layer 6 consists essentially completely of PCM. Suitable phase change materials which are contained in layer 6 or are used for forming this layer can, for example, be obtained from Outlast Technologies, Inc., Frisby Technologies, Inc. or BASF company. The phase change material is typically used in an amount of about 15 to 200 g/m$^2$, preferably about 25 to 80 g/m$^2$, and more preferably about 50 to 60 g/m$^2$. The preferred phase change material is provided in the form of microspheres being arranged in a binder material in order to form the center layer 6.

The embodiment of the grip tape 2 according to the present invention and as shown in FIG. 1 additionally comprises an inner layer 8 that is preferably made of felt and serves as a base or support layer. The inner layer 8 has preferably a trapezoidal cross-section so that wrapping the grip tape around the grip of a sports implement is facilitated. The center layer 6 and the inner layer 8 together have a thickness $d_2+d_3$ of preferably about 1.05 to 1.85 mm. Thus, the grip tape 2 has an overall thickness of preferably about 1.3 to 2.3 mm, more preferably about 1.3 to 2.0 mm. The inner layer 8, which serves as the base layer, can directly be connected with the center layer 6, e.g. by laminating, or can include a separate connecting layer 10, e.g. in the form of an adhesive layer. The same holds true for the connection between the outer layer 4 and the center layer 6, in which a connecting layer 12 can also be provided.

Figure 2:
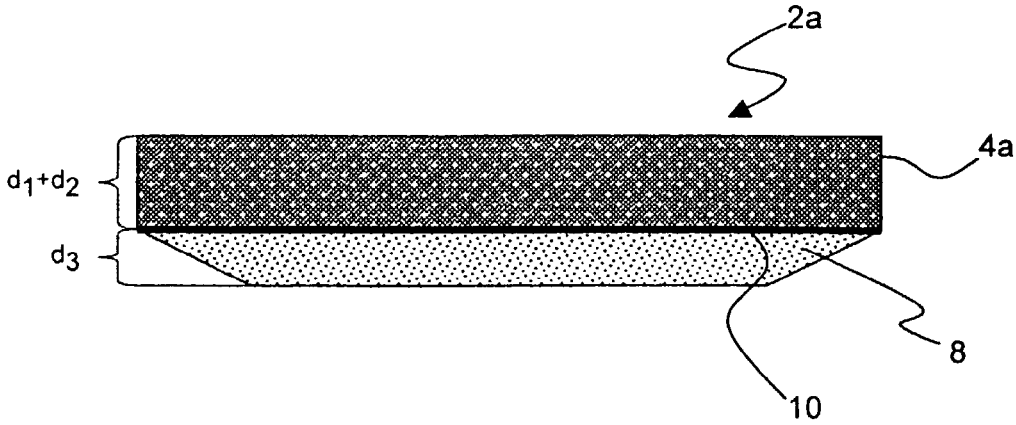
FIG. 2 is a cross-sectional view of a second embodiment of a grip tape according to the present invention.

FIG. 2 shows another preferred embodiment of a grip tape 2*a* according to the present invention. The structure of the grip tape 2*a* of FIG. 2 essentially corresponds to that of the grip tape 2 described with reference to FIG. 1; however, the grip tape 2*a* comprises an outer layer 4*a*, which is essentially a combination of layers 4 and 6 of FIG. 1, in other words, in the grip tape 2*a* the phase change material is integrated in the outer layer 4*a*. The layer 4*a* is preferably made of an open cell polyurethane material into which the phase change material is included. The amount of phase change material in the layer 4*a* preferably ranges between 15 and 200 g/m$^2$, more preferably between 25 to 80 g/m$^2$ and most preferably between 50 and 60 g/m$^2$. An optimum of the mass amount of phase change material in the layer 4*a* lies preferably in the range of about 5 to 20%, more preferably 10 to 15%. The grip tape 2*a* also has an inner layer 8 serving as the base or support layer and being made preferably of felt, on which the outer layer 4*a* is provided.

The embodiment of the grip tape 2*a* according to the present invention, as shown in FIG. 2, is configured of two main layers only, so that it can be produced more easily and at the same time the phase change material is arranged more closely to the player so that the desired cooling effect is achieved more quickly. Moreover, it surprisingly turned out that the cushioning effect in the grip tape 2*a* is particularly favorable as compared with conventional grip tapes.

The grip tape 2*a* according to FIG. 2 has an overall thickness of preferably about 1.3 to 2.3 mm, particularly preferably about 1.3 to 2.0 mm, wherein the outer layer 4 is about 0.10 to 0.80 mm thick, preferably about 0.15 to 0.50 mm, and the inner layer 8 is about 0.50 to 1.50 mm thick, preferably about 0.75 to 1.25 mm. In the embodiment according to FIG. 2 the outer layer 4*a* can be directly applied to the inner layer 8, or alternatively a connecting layer 10 can be present.

Figure 3:
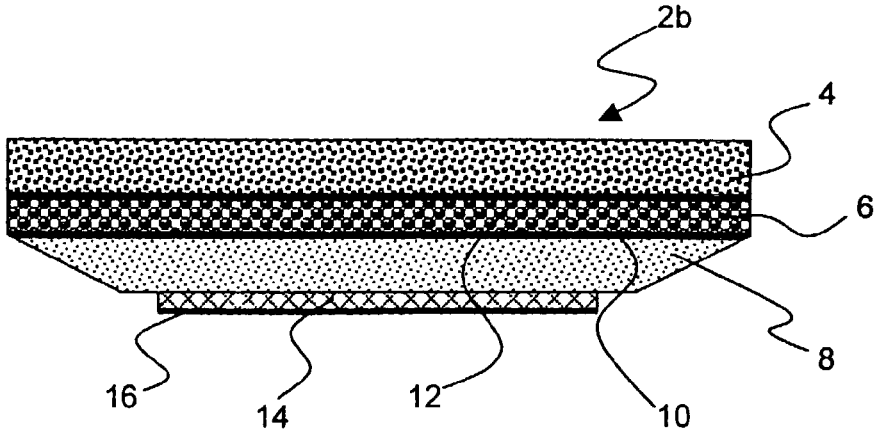
FIG. 3 is a cross-sectional view of a first embodiment of a replacement grip tape according to the present invention.

FIG. 3 shows an embodiment of a replacement grip tape 2*b* according to the present invention. The basic structure of the replacement grip tape 2*b* of FIG. 3 essentially corresponds to that of the grip tape 2 described with reference to FIG. 1. However, the replacement grip tape 2*b* additionally comprises an adhesive strip 14 extending essentially along the length of the grip tape. The adhesive strip 14 is provided on the inner surface of the layer 8, i.e. on the surface of the layer 8 facing away from the layers 4 and 6. Moreover, the adhesive strip 14 is preferably provided with a liner 16 which covers the exposed adhesive surface of the adhesive strip 14. For applying the replacement grip tape 2*b* to a grip of a sports implement, the liner 16 must first be removed in order to expose the adhesive surface of the adhesive strip 14, so that subsequently the replacement grip tape 2*b* can be wrapped about the grip of the sports implement.

Figure 4:
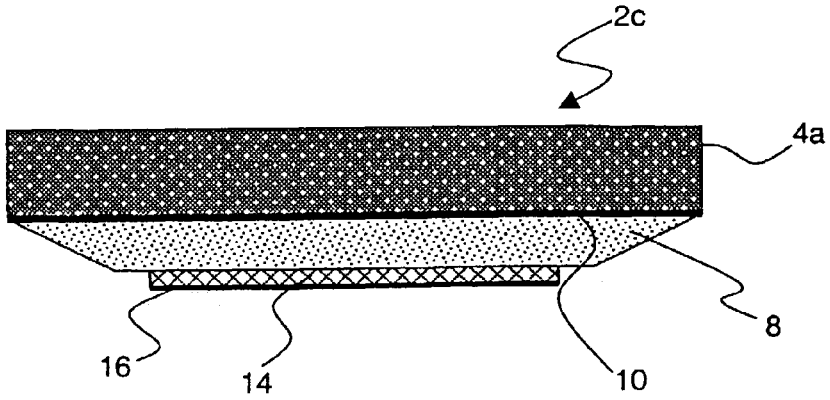
FIG. 4 is a cross-sectional view of a second embodiment of a replacement grip tape according to the present invention.

FIG. 4 shows a further embodiment of a replacement grip tape 2*c* according to the present invention. The structure of this replacement grip tape 2*c* essentially corresponds to the structure of the grip tape 2*a* described with reference to FIG. 2. Additionally, in this grip tape 2*c* an adhesive strip 14, which is preferably provided with a liner 16, is present on the surface of the layer 8 facing away from the phase change material.

Figure 5:
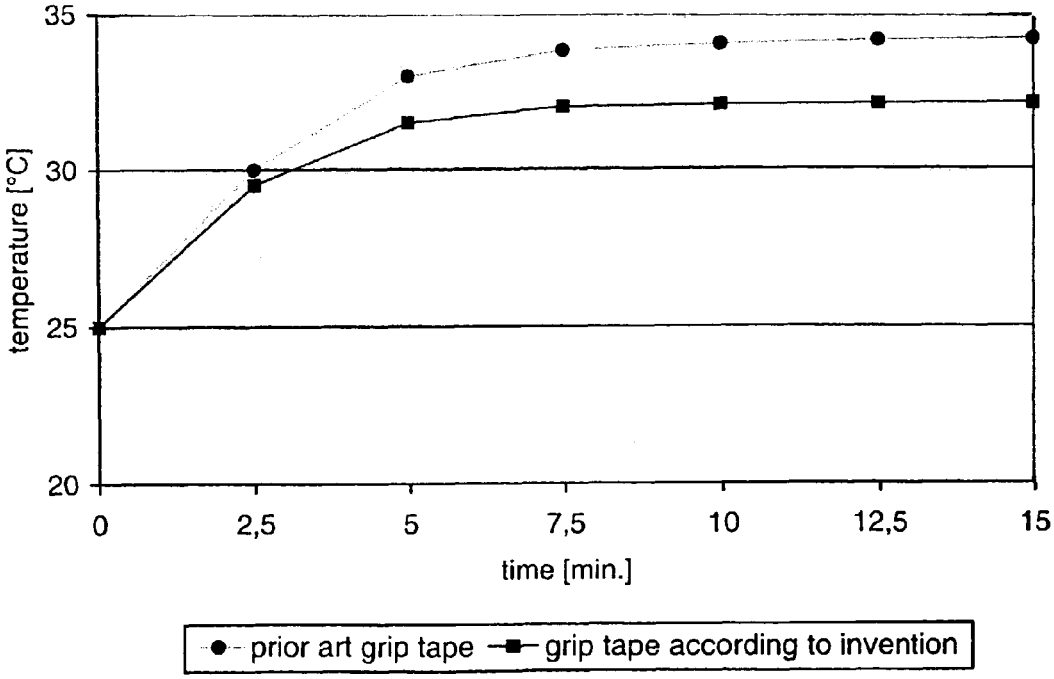
FIG. 5 is a diagram comparing the equilibrium temperatures of conventional grip tapes and grip tapes according to the present invention.

The diagram of FIG. 5 shows the equilibrium temperature which is provided between the hand of a player and a grip tape, depending on time, for a conventional grip tape and a grip tape or replacement grip tape according to the present invention. The structure of the conventional grip tape used for the comparison of FIG. 5 is that of the grip tape according to the present invention without a phase change material. The structure of the grip tape according to the present invention which was used for the measurement corresponds to that of the grip tape 2*a* shown in FIG. 2, in which the phase change material is integrated in the outer layer 4*a*. The mass amount of phase change material in the grip tape 2*a* used for this measurement example is 10%, and the outer layer 4*a* is made of open cell polyurethane material. This mass amount corresponds to about 55 g/m$^2$. As can be taken from the diagram of FIG. 5, already after about 5 minutes an equilibrium temperature is found for both the conventional grip tape and also for the grip tape according to the present invention. While in the conventional grip tape, however, the equilibrium temperature is about 34° C., in the grip tape according to the present invention, which comprises about 10% phase change material, the equilibrium temperature is about 32° C. Thus, due to the use of the phase change material, the equilibrium temperature of the grip tape according to the present invention is about 2° C. lower than that of a conventional grip tape. Consequently, the hand of the player sweats less with the grip tape according to the present invention, so that less liquid has to be absorbed by the grip tape. This leads to an improved grip feeling because the characteristic of the grip tape (e.g., tack, cushioning effect) is constant or is at least retained over a longer period of time. Moreover, it turned out that the addition of the phase change material does not change the liquid carrying-off and/or the liquid storing capacity. It is a further surprising effect that due to the use of the phase change material the cushioning effect is influenced in a particularly favorable manner which leads to an additional improvement of the grip feeling.

For producing the grip tape according to the present invention, the heat change material can, as already discussed above, be integrated in the outer layer 4*a* consisting preferably of open cell polyurethane material or foam (according to the embodiments of FIGS. 2 and 4) or be applied to the inner layer 8 as a separate layer 6 (according to the embodiments of FIGS. 1 and 3). Alternatively or additionally, a separate phase change material layer can also be applied to the outside of the outer layer 4. However, the application to the inner layer 8 is preferred because this offers the additional possibility to needle punch the inner layer 8, which is preferably made of felt, so that it has improved moisture absorption properties.

Furthermore, the surface of the grip tape can be provided with a pattern, for example in the form of a stroke or symbol, for example by embossing. Moreover, openings or holes can be formed in the grip tape in order to improve moisture absorption and/or ventilation.

Under the inner layer 8 at least a further layer may be formed, said further layer having, for example, a different color, shock-absorbing effect and/or a particularly good cushioning effect. Felt, non-woven or elastomeric materials can, e.g., be used for this/these additional layer(s). Even with the additional layer(s), the overall thickness of such grip tapes according to the present invention should range preferably between 1.3 and 2.3 mm, particularly preferably 1.3 and 2.0 mm.

The invention claimed is:

1. A grip tape for sports implements, said grip tape comprising a phase change material provided within microspheres configured to change phase from a solid to a liquid at approximately 32-38° C. wherein heat is absorbed during liquification and released during solidification.

2. The grip tape according to claim 1 comprising a layer structure including at least two stacked layers.

3. The grip tape according to claim 1 comprising an inner layer and an outer layer, wherein the inner layer is made of felt and the outer layer comprises an open cell polyurethane material including the phase change material.

4. The grip tape according to claim 1, wherein the phase change material is provided in an amount of about 15 to 200 $g/m^2$.

5. The grip tape according to claim 1 having a thickness of about 1.3 to 2.3 mm.

6. The grip tape according to claim 3, wherein the outer layer has a thickness ($d_1+d_2$) of about 0.10 to 0.80 mm, and the inner layer has a thickness ($d_3$) of about 0.50 to 1.50 mm.

7. The grip tape according to claim 1, wherein a plurality of different phase change materials is provided.

8. A replacement grip tape for sports implements, said grip tape comprising a layer structure consisting of at least two layers, wherein one layer is an adhesive layer and at least one further layer comprises a phase change material provided within microspheres for dissipating and/or storing body heat of a player, the phase change material being configured to change phase from a solid to a liquid at approximately 32-38° C. wherein heat is absorbed during liquification and released during solidification.

9. The replacement grip tape according to claim 8 comprising a layer made of felt and arranged on the adhesive layer and an outer layer comprising an open cell polyurethane material including the phase change material.

10. The replacement grip tape according to claim 8, wherein the phase change material is provided in an amount of about 15 to 200 $g/m^2$.

11. The replacement grip tape according to claim 8 having a thickness of about 1.3 to 2.5 mm.

12. The replacement grip tape according to claim 9, wherein the outer layer has a thickness ($d_1+d_2$) of about 0.10 to 0.80 mm, and the felt layer has a thickness ($d_3$) of about 0.50 to 1.50 mm.

13. The replacement grip tape according to claim 8, wherein a plurality of different phase change materials is provided.

14. Use of the grip tape according to claim 1 for wrapping around the handle of a tennis racquet, squash racquet, racquetball racquet, badminton racquet or golf club.

15. The grip tape according to claim 4, wherein the phase change material is provided in an amount of about 25 to 80 $g/m^2$.

16. The grip tape according to claim 15, wherein the phase change material is provided in an amount of about 50 to 60 $g/m^2$.

17. The grip tape according to claim 6, wherein the outer layer has a thickness ($d_1+d_2$) of about 0.15 to 0.50 mm, and the inner layer has a thickness ($d_3$) of about 0.75 to 1.25 mm.

18. The grip tape according to claim 1, wherein the phase change material is adapted such that the temperature range of the phase change is between about 34° C. and 36° C.

19. The grip tape according to claim 18, wherein the phase change material is adapted such that the temperature of the phase change is about 35° C.

20. The grip tape according to claim 1, wherein the grip tape is a replacement grip tape including an adhesive layer.

21. The grip tape according to claim 10, wherein the phase change material is provided in an amount of about 25 to 80 $g/m^2$.

22. The grip tape according to claim 21, wherein the phase change material is provided in an amount of about 50 to 60 $g/m^2$.

23. The replacement grip tape according to claim 12, wherein the outer layer has a thickness ($d_1+d_2$) of about 0.15 to 0.50 mm, and the felt layer has a thickness ($d_3$) of about 0.75 to 1.25 mm.

24. The grip tape according to claim 8, wherein the phase change material is adapted such that the temperature range of the phase change is between about 34° C. and 36° C.

25. The grip tape according to claim 24, wherein the phase change material is adapted such that the temperature of the phase change is about 35° C.

26. A grip tape for sports implements, said grip tape comprising an inner layer and an outer layer, wherein the inner layer is made of felt and the outer layer comprises an open cell polyurethane material that includes a phase change material provided within microspheres configured to change phase from a solid to a liquid at approximately 32-38° C. wherein heat is absorbed during liquification and released during solidification.

27. The grip tape according to claim 26, wherein the phase change material is provided in an amount of about 15 to 200 $g/m^2$.

28. The grip tape according to claim 26 having a thickness of about 1.3 to 2.3 mm.

29. The grip tape according to claim 26, wherein the outer layer has a thickness ($d_1+d_2$) of about 0.10 to 0.80 mm, and the inner layer has a thickness ($d_3$) of about 0.50 to 1.50 mm.

30. The grip tape according to claim 26, wherein a plurality of different phase change materials is provided.

31. Use of the grip tape according to claim 26 for wrapping around the handle of a tennis racquet, squash racquet, racquetball racquet, badminton racquet or golf club.

32. The grip tape according to claim 27, wherein the phase change material is provided in an amount of about 25 to 80 $g/m^2$.

33. The grip tape according to claim 32, wherein the phase change material is provided in an amount of about 50 to 60 $g/m^2$.

34. The grip tape according to claim 29, wherein the outer layer has a thickness ($d_1+d_2$) of about 0.15 to 0.50 mm, and the inner layer has a thickness ($d_3$) of about 0.75 to 1.25 mm.

35. The grip tape according to claim 26, wherein the phase change material is adapted such that the temperature range of the phase change is between about 34° C. and 36° C.

36. A grip tape for sports implements, said grip tape comprising a layer structure consisting of at least two layers, wherein one layer is an adhesive layer having a layer of felt with a thickness of about 0.50 to 1.50 mm arranged thereon and at least one further outer layer having a thickness of about 0.10 to 0.80 mm comprised of an open cell polyurethane material including a phase change material provided within miscrospheres for dissipating and/or storing body heat of a player, the phase change material being configured to change phase from a solid to a liquid at approximately 32-38° C. wherein heat is absorbed during liquification and released during solidification.

37. The grip tape according to claim 36, wherein the phase change material is provided in an amount of about 15 to 200 $g/m^2$.

38. The grip tape according to claim 36 having a thickness of about 1.3 to 2.5 mm.

39. The grip tape according to claim 36, wherein a plurality of different phase change materials is provided.

40. The grip tape according to claim 37, wherein the phase change material is provided in an amount of about 25 to 80 $g/m^2$.

41. The grip tape according to claim 40, wherein the phase change material is provided in an amount of about 50 to 60 $g/m^2$.

42. The grip tape according to claim 36, wherein the grip tape is a replacement grip tape including an adhesive layer.

* * * * *